United States Patent [19]

Wassenhoven

[11] Patent Number: 4,724,668

[45] Date of Patent: Feb. 16, 1988

[54] METHOD AND APPARATUS FOR THE FORMATION OF SPINNING FIBERS

[75] Inventor: Heinz-Georg Wassenhoven, Monchen-Gladbach, Fed. Rep. of Germany

[73] Assignee: W. Schlafhorst & Co., Monchen-Gladbach, Fed. Rep. of Germany

[21] Appl. No.: 70,641

[22] Filed: Jul. 6, 1987

[30] Foreign Application Priority Data

Jan. 21, 1984 [DE] Fed. Rep. of Germany ..... 3402084

Related U.S. Application Data

[63] Continuation of Ser. No. 867,904, May 20, 1986, abandoned, which is a continuation of Ser. No. 692,823, Jan. 18, 1985, abandoned.

[51] Int. Cl.[4] ..... D01H 7/92; D01H 7/898

[52] U.S. Cl. ..... 57/333; 57/400; 57/403

[58] Field of Search ..... 57/5, 315, 328, 333, 57/400, 401, 403

[56] References Cited

U.S. PATENT DOCUMENTS

| | | | |
|---|---|---|---|
| 2,911,783 | 11/1959 | Götzfried | 57/403 |
| 2,928,228 | 3/1960 | Götzfried | 57/403 |
| 3,635,006 | 1/1972 | Fehrer | 57/401 |
| 3,844,097 | 10/1974 | Bobkowicz et al. | 57/401 X |
| 3,924,396 | 12/1975 | Bobkowicz et al. | 57/400 X |
| 4,044,537 | 8/1977 | Negishi et al. | 57/404 X |
| 4,249,368 | 2/1981 | Fehrer | 57/401 X |
| 4,319,448 | 3/1982 | Jóźwicki et al. | 57/403 |
| 4,497,168 | 2/1985 | Kamp | 57/401 |
| 4,507,913 | 4/1985 | Morrison | 57/403 |
| 4,672,800 | 6/1987 | Fehrer | 57/401 X |
| 4,676,062 | 6/1987 | Brockmanns et al. | 57/400 |

*Primary Examiner*—Stuart S. Levy
*Assistant Examiner*—Joseph J. Hail, III

[57] ABSTRACT

For improving spinning results, a sideways limited swarm of fibers (11) is applied tangentially at the mantle of a rotating perforated drum (3) whose interior is supplied with suction air, is transported further on this drum (3) in the peripheral direction by the action of suction air, then is clamped between drum (3) and a contacting clamping element (20), and is continuously sucked out from the clamping line (23) by a pneumatic spinning device (27), and transformed to a thread (28).

10 Claims, 3 Drawing Figures

METHOD AND APPARATUS FOR THE FORMATION OF SPINNING FIBERS

This application is a continuation of application Ser. No. 867,904, filed May 20, 1986, now abandoned, which is a continuation of application Ser. No. 692,823, filed Jan. 18, 1985, now abandoned.

The invention relates to a method and an apparatus for the formation of spinning fibers for producing a thread.

The forming of a thread from spinning fibers has quality and productivity limitations, where the adjusting of the fiber supply with respect to thread withdrawal and thread twist are difficult.

For this reason all spinning methods known up to this time could use some improvement, and from time to time new spinning methods and new spinning devices come up, which sometimes replace the old methods and devices.

The invention has the basic objective to improve the formation of the spinning fibers before the actual spinning operation, this means before the actual generating of the thread, so that also the result of the spinning is improved with respect to quality, fineness of the thread, and also production rate.

With the foregoing objective in view, there is provided in accordance with the invention a method for forming spinning fibers for producing a thread, which comprises continuously applying a swarm of spinning fibers, limited at the sides of the swarm, to an outer peripheral surface of a rotating perforated drum having an interior acted upon by suction air, transporting the swarm of spinning fibers farther on the drum in peripheral direction thereof under the action of the suction air, clamping the swarm of spinning fibers between the drum and at least one clamping element along a clamping line, and continuously sucking and pneumatically applying a twist to the swarm of spinning fibers out of the clamping line with a pneumatic spinning device and transforming it into a twisted thread.

In accordance with another mode of the invention, there is provided a method which includes loosening the swarm of spinning fibers from a sliver with a loosening device before the swarm reaches the perforated drum, and guiding and transporting the swarm in a fiber-carrying air current through a fiber channel terminating at the perforated drum.

In accordance with an added mode of the invention, the suction air acts upon the interior of the perforated drum only in at least one defined suction zone terminating at most up to the clamping line.

In accordance with another aspect of the invention, there is provided a device for forming spinning fibers for producing a thread, comprising a rotatably mounted perforated drum having a hollow interior acted upon by suction air, and tangentially sucking, holding and transporting a swarm of spinning fibers in peripheral direction of the perforated drum, a clamping device mounted adjacent the drum and clampingly actuable upon the sucked swarm of spinning fibers and forming a clamping line with an outer peripheral surface of the perforated drum, and a pneumatic spinning device located downstream from and adjacent the clamping line, in transport direction of the swarm of spinning fibers, the pneumatic spinning device having means for applying suction and a twist pneumatically to the swarm of spinning fibers and transforming it into a twisted thread.

In accordance with a further feature of the invention, the means of the pneumatic spinning device has an injector arrangement for applying suction and a twist to the thread.

In accordance with an additional feature of the invention, there is provided a fiber loosening device located upstream of the perforated drum in the transport direction of the swarm of spinning fibers.

In accordance with again another feature of the invention, the fiber loosening device includes a rotatable loosening roller formed with an array of needles at an outer surface of said loosening roller.

In accordance with again a further feature of the invention, the fiber loosening device includes a rotatable loosening roller formed with an array of saw-teeth at an outer surface of the loosening roller.

In accordance with again an added feature of the invention, the perforated drum is formed with a peripheral casing and has a suction device in the interior thereof, the suction device being formed with a suction slot extending from the inside of the perforated drum towards the outer peripheral casing.

In accordance with still another feature of the invention, the suction slot terminates a slight distance from the outer peripheral casing of the perforated drum for avoiding a sliding contact.

In accordance with still an additional feature of the invention, the fiber loosening device has a fiber channel guiding the swarm of spinning fibers and terminating at a fiber feeding location spaced slightly from the perforated drum.

In accordance with still a further feature of the invention, the fiber channel tapers downwardly towards the end thereof.

In accordance with yet an added feature of the invention, only a part of the perforated drum located, respectively, at the fiber feeding location is able to be acted upon by the suction air from within the drum.

In accordance with yet another feature of the invention, the fiber feeding location extends over an angle of 90° to 120° around the peripheral surface of the drum.

In accordance with a concomitant feature of the invention, the clamping device comprises a clamping roller lying on the perforated drum.

The advantages obtained with the invention lie especially in the facts that a uniform thread, and if desired, a very fine thread, can be produced at a very high production rate.

Advantageous further developments of the invention are described in the method- and apparatus claims.

The invention and its advantages will be further explained and described with the aid of specific embodiments which are used as examples.

Figure 1:
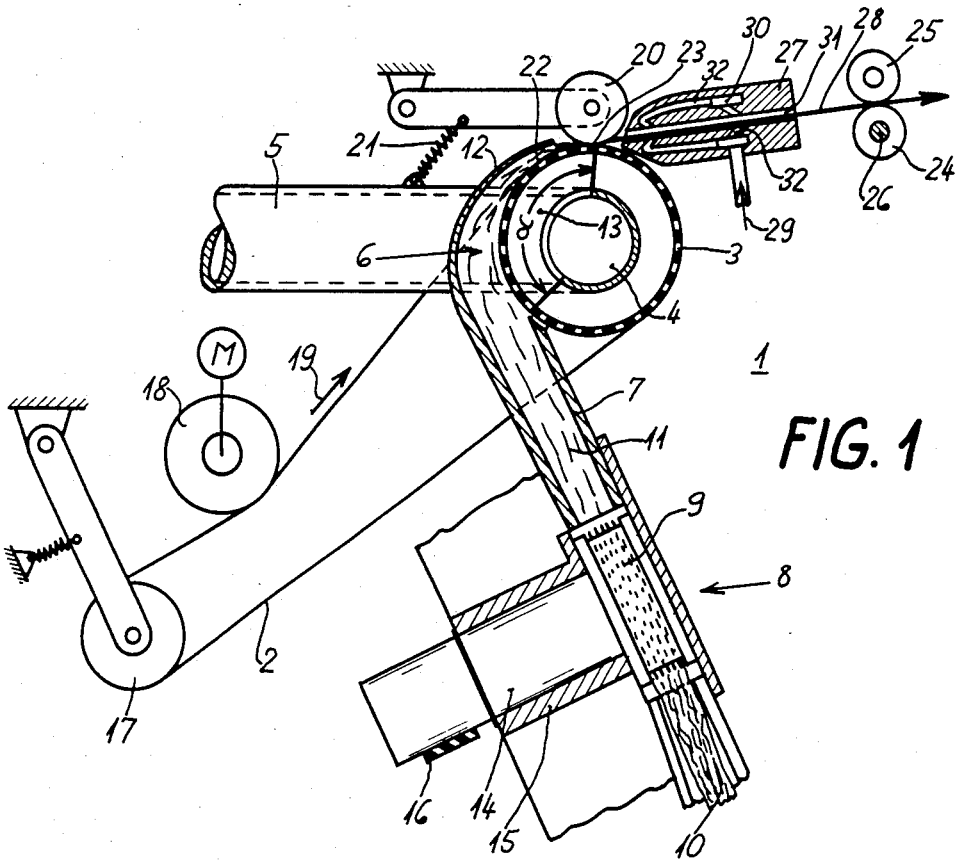
FIG. 1 shows schematically a cross-section through the apparatus according to the invention.

FIG. 1 shows schematically the apparatus 1 for the formation of spinning fibers, with a rotatably supported drive drum 3, which can be driven by a drive belt 2. The mantle of the drum 3 is perforated. In the interior of the drum 3 is a suction device 4, which is connected to a suction tube 5. The suction tube 5 terminates at an exhaustor which is not shown here.

The drum 3 rotates in front of a fiber feeding region which is designated by 6. The fiber canal 7 of a fiber loosening device 8 terminates at the fiber feeding region 6. The fiber loosening device 8 contains a rotatable loosening roller 9, which is provided with needles at its surface, which loosens and combs-out the admitted fiber sliver 10 to a great number of spinning fibers 11. The loosened fibers are grabbed by a current of suction air which is generated by the negative pressure in the device 4.

Figure 2:
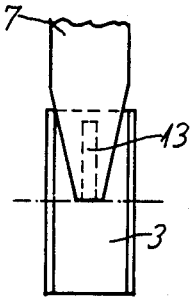
FIG. 2 shows a top view onto the fiber canal of the apparatus, according to FIG. 1.

The termination of the fiber canal 7 extends over a peripheral angle of about 120 degree around the drum 3. The end of the fiber canal 7 forms a fiber guide surface 12, which extends around the drum 3, and tapers upward, and also sideways as shown in FIG. 2. Opposite to the termination of the fiber canal 7 in the interior of drum 3 a suction slit 13 is arranged, which has the effect that only at the fiber feeding region 6 suction air acts on the perforated drum 3. The suction slit 13 includes an opening angle of about 120 degrees.

FIG. 1 shows that the loosening roller 9 has a shaft 14 which is supported in a bearing 15, and is set in rotation by a tangential belt 16. The drive belt 2 which drives the drum 3 runs over a spring loaded tension roller 17, and by a motor-driven roller 18 is driven in the direction of arrow 19.

At the end of the fiber feeding region 6 is a clamping device in the form of a clamping roller 20. The clamping roller 20 lies on drum 3 under the action of spring 21, and forms with the outer mantle 22 of the drum 3 a clamping line 23 appearing as a point in the drawing.

Seen from the clamping line 23 in the radial direction, which is identical to the direction the thread is pulled, a thread pulling device is arranged, consisting of a pulling-roller 24, and a clamping roller 25. The pulling roller 24 is driven by a shaft 26.

Between the clamping line 23, and the thread pulling device 24, 25 a pneumatic spinning device 27 is arranged. It consists of a thread twisting nozzle through which the thread is conducted, and which extends into the vicinity of clamping line 23. The pneumatic spinning device 27 is supplied with compressed air in the direction of arrow 29, whereby the compressed air distributes itself in the ring channel 30 and reaches the thread 28 with a tangential component through the injector nozzles 32 which terminate in a nozzle canal 31, and induces a twist to the thread in the required direction, and sucks the fibers at the same time away from the clamping line 23 by an injection effect. The injection nozzles 32, and the nozzle canal 31 form together an injector arrangement.

During the operation of the apparatus 1 the negative pressure in the suction device 4 generates in the fiber canal 7 an air current which carries the continuously arriving swarm of spinning fibers 11, and transports it to the fiber feeding region 6. There the fibers lie against the outer mantle 22 of the rotating perforated drum 3, and are transported to the clamping line 23, and from there discharged into the pneumatic spinning device 27.

By the feature that the fiber feeding region is acted upon by the suction-air, the expended energy is used strictly for spinning purposes. The chosen angular configuration of the fiber feeding region promises especially good spinning results. The construction of the clamping device as a clamping roller has the advantage that there is no sliding friction at the clamping line 23. A cover layer on the clamping roller made of a rubber-elastic material helps to prevent damaging the fibers, and guarantees the effectiveness of the clamping device.

Figure 3:
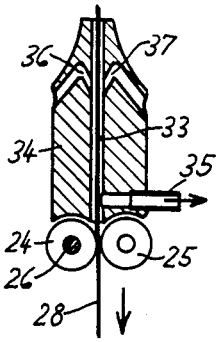
FIG. 3 shows a section through the pneumatic spinning device.

FIG. 3 shows another configuration of the pneumatic spinning device. Here the pneumatic spinning device 34 is constructed also as a thread-twisting nozzle through which the thread is conducted, and which extends into the vicinity of the clamping line. The pneumatic spinning device is provided with a suction device in the form of the suction tube 35, which branches off from the rear end of the nozzle canal 33, whereby this suction tube is connected to a suction source which is not shown. The twist of the thread is generated here by ejector nozzles 36, 37, which terminate at a slant with a tangential component into the nozzle canal.

The invention should not be limited to the illustrated and described embodiment which was used as an example.

I claim:

1. Method of forming spinning fibers for producing a thread, which comprises continuously applying in a suction zone a swarm of spinning fibers, limited at the sides of the swarm, tangentially to an outer peripheral surface of a rotating perforated drum having an interior acted upon by suction air, via a fiber channel terminating at an end thereof at a slight distance from the outer peripheral surface of the perforated drum and tapering towards the end, the suction zone being formed by a suction device having a suction slot directed towards the outer peripheral surface of the perforated drum and spaced therefrom a slight distance for preventing abrasive contact, transporting the swarm of spinning fibers father on the outer peripheral surface of the drum in the peripheral and rotational direction of the drum, under the action of the suction air flowing through the perforations of the drum, to a clamping line which is an ultimate limit of the suction zone and is formed on the outer peripheral surface of the drum by at least one clamping element lying on the drum, clamping the swarm of spinning fibers between the drum and the clamping element along the clamping line and extended over a relatively wide area due to the suction and clamping action, and continuously sucking the swarm of spinning fibers out of the clamping line by a pneumatic spinning device located adjacent the clamping line and simultaneously applying a twist thereto so as to transform the swarm of spinning fibers into a twisted thread.

2. Method according to claim 1, which includes loosening the swarm of spinning fibers from a sliver with a loosening device before the swarm reaches the perforated drum, and guiding and transporting the swarm in a fiber-carrying air current through the fiber channel terminating at the perforated drum.

3. Device for forming spinning fibers for producing a thread, comprising a rotatably mounted perforated drum having a hollow interior acted upon by suction air, and a fiber channel for guiding a swarm of spinning fibers, said fiber channel terminating at an end thereof at a fiber applying location with a slight spacing from the perforated drum, and tapering towards said end thereof, said perforated drum being rotatably mounted for tangentially sucking, holding and further transporting in peripheral direction the swarm of spinning fibers, a clamping device mounted adjacent said drum and clampably actuable upon the sucked swarm of spinning fibers and forming a clamping line with an outer peripheral surface of said perforated drum, a pneumatic spinning device located downstream from and adjacent said clamping line, said pneumatic spinning device having means for applying suction and a twist pneumatically to the swarm of spinning fibers and transforming the swarm into a twisted thread, and a suction device located in the interior of said perforated drum and formed with a suction slot extending from the interior towards the outer peripheral surface of said perforated drum, said suction slot terminating at a slight distance from said outer peripheral surface of said perforated drum for preventing abrasive contact.

4. Device according to claim 3, wherein said means of said pneumatic spinning device has an injector arrangement for applying suction and a twist to the thread.

5. Device according to claim 3, including a fiber loosening device located upstream of said perforated drum in said transport direction of said swarm of spinning fibers.

6. Device according to claim 5, wherein said fiber loosening device includes a rotatable loosening roller formed with an array of needles at an outer surface of said loosening roller.

7. Device according to claim 5, wherein said fiber loosening device includes a rotatable loosening roller formed with an array of saw-teeth at an outer surface of said loosening roller.

8. Device according to claim 3, wherein only a part of said perforated drum located, respectively, at said fiber feeding location is able to be acted upon by the suction air from within said drum.

9. Device according to claim 3, wherein said fiber applying location extends over an angle of 90° to 120° around the peripheral surface of said drum.

10. Device according to claim 3, wherein said clamping device comprises a clamping roller lying on said perforated drum.

* * * * *